United States Patent [19]

Cordrey

[11] 4,434,971

[45] Mar. 6, 1984

[54] DRILLING RIG DRAWWORKS HOOK LOAD OVERSPEED PREVENTING SYSTEM

[75] Inventor: Richard N. Cordrey, Rancho Palos Verdes, Calif.

[73] Assignee: Armco Inc., Middletown, Ohio

[21] Appl. No.: 233,561

[22] Filed: Feb. 11, 1981

[51] Int. Cl.[3] ..... B66D 1/48; E21B 19/00

[52] U.S. Cl. ..... 254/273; 173/11; 175/27; 254/275; 254/276; 254/375; 254/379; 303/16; 340/665; 340/666; 364/555; 364/562

[58] Field of Search ..... 254/273, 276, 272, 274, 254/345, 378, 379; 340/665, 666, 686; 364/562, 463, 555; 303/16, 93; 173/11; 175/24, 27

[56] References Cited

U.S. PATENT DOCUMENTS

| | | | |
|---|---|---|---|
| 2,634,405 | 4/1953 | Stone et al. | 340/685 |
| 2,950,086 | 8/1960 | Abraham . | |
| 3,031,169 | 4/1962 | Robinson et al. | 254/273 |
| 3,104,864 | 9/1963 | Melton et al. | 254/273 |
| 3,578,817 | 5/1971 | Eastcott | 303/16 |
| 3,638,211 | 1/1972 | Sanchez | 340/267 |
| 3,759,489 | 9/1973 | Jones | 254/273 |
| 3,995,831 | 12/1976 | Spanski et al. . | |
| 4,046,355 | 9/1977 | Martin . | |
| 4,128,888 | 12/1978 | Sheldon | 364/565 |
| 4,139,891 | 2/1979 | Sheldon | 364/567 |
| 4,178,591 | 12/1979 | Geppert | 340/685 |

*Primary Examiner*—Billy S. Taylor
*Attorney, Agent, or Firm*—Frost & Jacobs

[57] ABSTRACT

The method and apparatus for preventing runaway lowering of a hook block in an oil drilling rig characterized by monitoring the instantaneous values of hook load and speed and using these values together with parameters associated with the rig drawworks to calculate an energy value which must be dissipated during a braking stop by the drawworks brake. The brake or an emergency brake associated with the drawworks is automatically actuated when the calculated energy value reaches a predetermined value representative of the maximum energy absorbing capability of the brake. The brake may also be automatically activated when the position of the hook block reaches predetermined upper and lower limits. The processor associated with the system also calculates a hoist value representative of the normal energy dissipating rating of the brake and activates an alarm if this value is matched by the calculated energy value for a particular load and speed, and a second value representative of the maximum energy dissipating capacity of the brake for emergency stopping, and activates the brake if the second value is matched by the calculated energy value for a particular load and speed.

21 Claims, 4 Drawing Figures

DRILLING RIG DRAWWORKS HOOK LOAD OVERSPEED PREVENTING SYSTEM

SUMMARY OF THE INVENTION

The present invention is directed to drawworks for oil drilling rigs, and more particularly to a computer-controlled system for preventing excessive downward speed of the load bearing hook assembly which may not be able to be stopped by the manual primary brake.

It is well known in the oil drilling art to utilize a drawworks in connection with the oil drilling rig or derrick to raise or lower pipe stands and drill string into and out of the well bore. Generally, the raising and lowering operation is accomplished by means of a hook block which is secured in block and tackle fashion to a crown block secured to the top of the well derrick.

The raising and lowering operation is controlled by means of a hoist cable or rope, one end of which is fixedly secured to the ground forming a so-called "dead line", with the other end being secured to the drawworks proper, and forming the "fast line".

The drawworks includes a rotatable cylindrical drum upon which the cable is wound by means of a suitable prime mover and power transmission assembly. In connection with the lowering operation, the drawworks is supplied with a primary friction brake used to stop the hook block travel, and an auxiliary brake, often of the eddy current type, which is used to control the rate of lowering of the hook block bearing the load. For the purposes of the present invention, the drawworks may also be provided with an emergency brake which can be activated in the event of power failure to the eddy current brake or when the hook block has been allowed to exceed a maximum safe falling speed.

Inasmuch as a typical load borne by the hook block may exceed four hundred tons or more, a failure in any of the brake systems controlling the rate of downward travel of the hook block may be catastrophic resulting in equipment damage as well as possible loss of human life.

The present invention is directed to a system for sensing when the downward speed of travel of the hook block exceeds safe operating limits in light of the particular load being handled. While prior art workers have suggested means for monitoring the speed or velocity of the hook block and providing an alarm in cases where a predetermined maximum velocity is exceeded, these methods fail to take into account the actual momentum of the load and the ability of the braking means to bring the load safely to a halt within a predetermined time or distance.

The overspeed preventing means of the present invention is particularly applicable in an oil well drilling rig of the type having a supporting derrick, a traveling hook block mounted for vertical movement within the derrick, and a wire rope hoisting line for raising and lowering the block where one end of the rope is fixedly secured to form a "dead line", and the other end of the rope forms a "fast line". Drawwork means raise and lower the block, these means including a rotatable drum for wrapping the fast line thereon and brake means for controlling and stopping the rotation of the drum when the block is being lowered. Often the speed control brake means take the form of an eddy current brake which provides an opposing and variable force to retard rotation of the winding drum and thereby limit downward velocity of the hook block. This speed limiting brake acquires significant angular velocity to develop its opposing force and hence is not capable of halting the downward travel of the hook load by itself. Consequently, stopping action is provided by the drawworks drum primary friction type band brake system. This brake is normally adequate to halt the hook block as long as hook load and speed do not require brake energy dissipation in excess or the band brake's capacity.

The improvement of the present invention comprises means for preventing a runaway load condition and includes load sensing means attached to the dead line or other suitable location which produces an electrical signal representative of the load carried by the hook block. Speed sensing means are also provided to produce an electrical signal representative of the downward speed of the block. In a preferred embodiment, the speed sensing means comprises a position encoder connected to the drawworks drive shaft which produces a signal representative of winding drum rotation and consequently the vertical position of the hook block, with this signal being differentiated to produce a velocity signal. The actual position and load of the hook block may also be displayed on a suitable visual display.

In a preferred embodiment, emergency brake means in the form of a pneumatically operated brake is connected to the drawworks drum to stop rotation thereof. Spring applied or hydraulically operated brakes may also be used for this purpose.

The present invention also includes processor means in the form of a digital computer for calculating from the speed and load signals an energy value that must be dissipated during a braking stop. When the calculated energy value exceeds a predetermined level representative of the maximum energy absorbing capability of the drawworks primary band brake system, the emergency brake is activated. In addition, the position signal may be utilized to cause activation of the emergency brake in the event the hook block comes within a predetermined distance of the crown block or the floor of the derrick. In addition, alarm means may be provided to provide an audible or visual indication when the speed or position of the hook block exceeds the predetermined safety limits.

Finally, the torque required by the emergency brake may also be calculated by the processor means and utilized in connection with the brake to provide a controlled stopping time proportional to the value of the required brake torque.

Further features of the invention will become apparent from the detailed description which follows.

DETAILED DESCRIPTION

Figure 1:
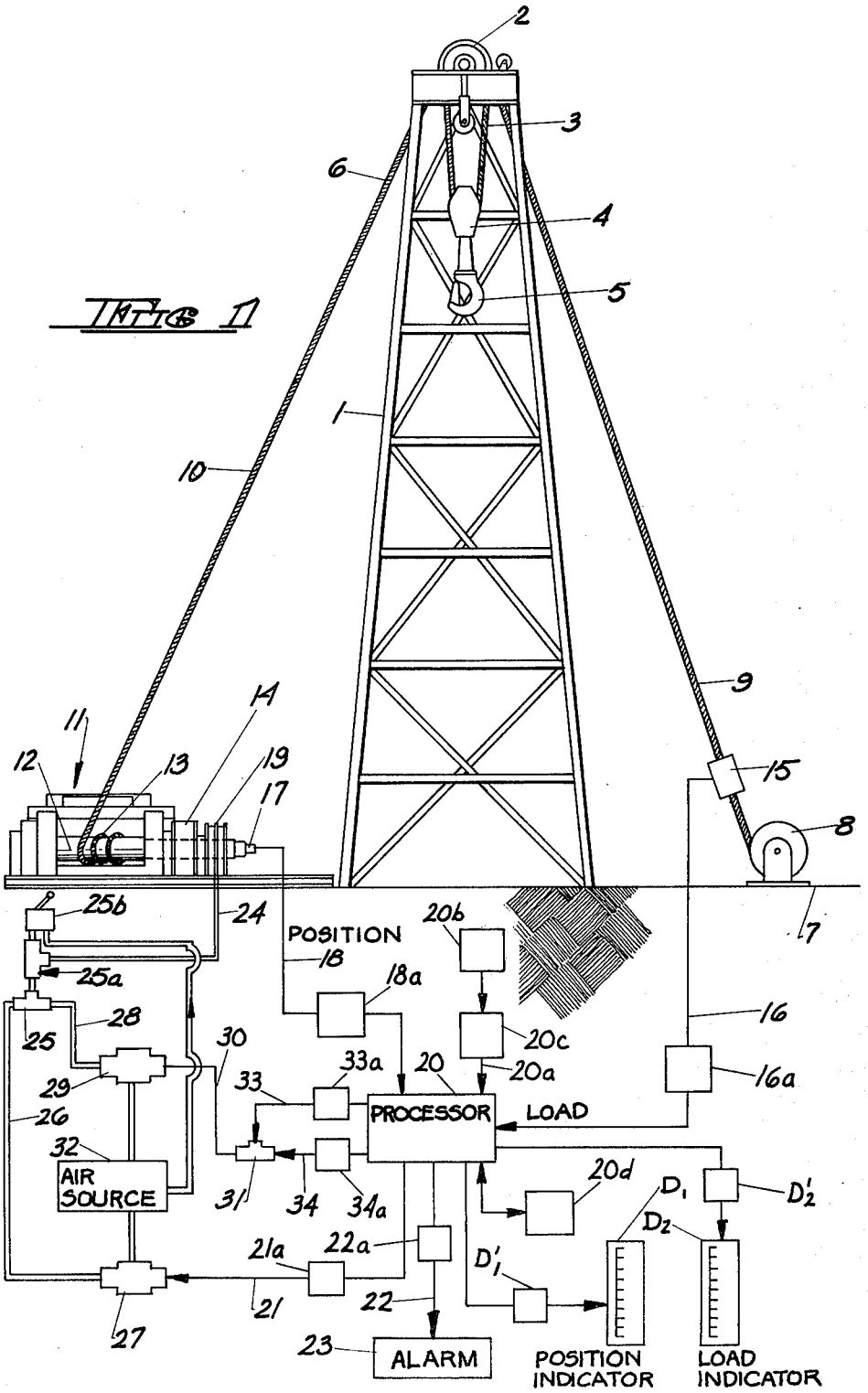
FIG. 1 is a partially schematic block diagram of the drilling rig drawworks hook load overspeed preventing system of the present invention.

The hook load overspeed preventing system of the present invention is illustrated schematically in FIG. 1.

A vertically oriented drilling mast or derrirk 1 supports, at its upper end, the usual crown block 2. Suspended from crown block 2 by a rope arrangement or reaving 3 is a traveling block 4 which supports a hook structure 5. Alternatively, traveling block 4 may be formed as a conventional hook block. As used herein, the term "hook block" refers to the load bearing part 4 of the hoist assembly attached to reaving 3.

Associated with crown block 2 and hook block 4 is a hoisting rope 6, one end of which is fixedly secured to the ground as at 7 by means of a dead line anchor 8 to form a dead line 9. The other end of hoisting rope 6 forms a fast line 10 associated with the drawworks, shown generally at 11.

Figure 4:
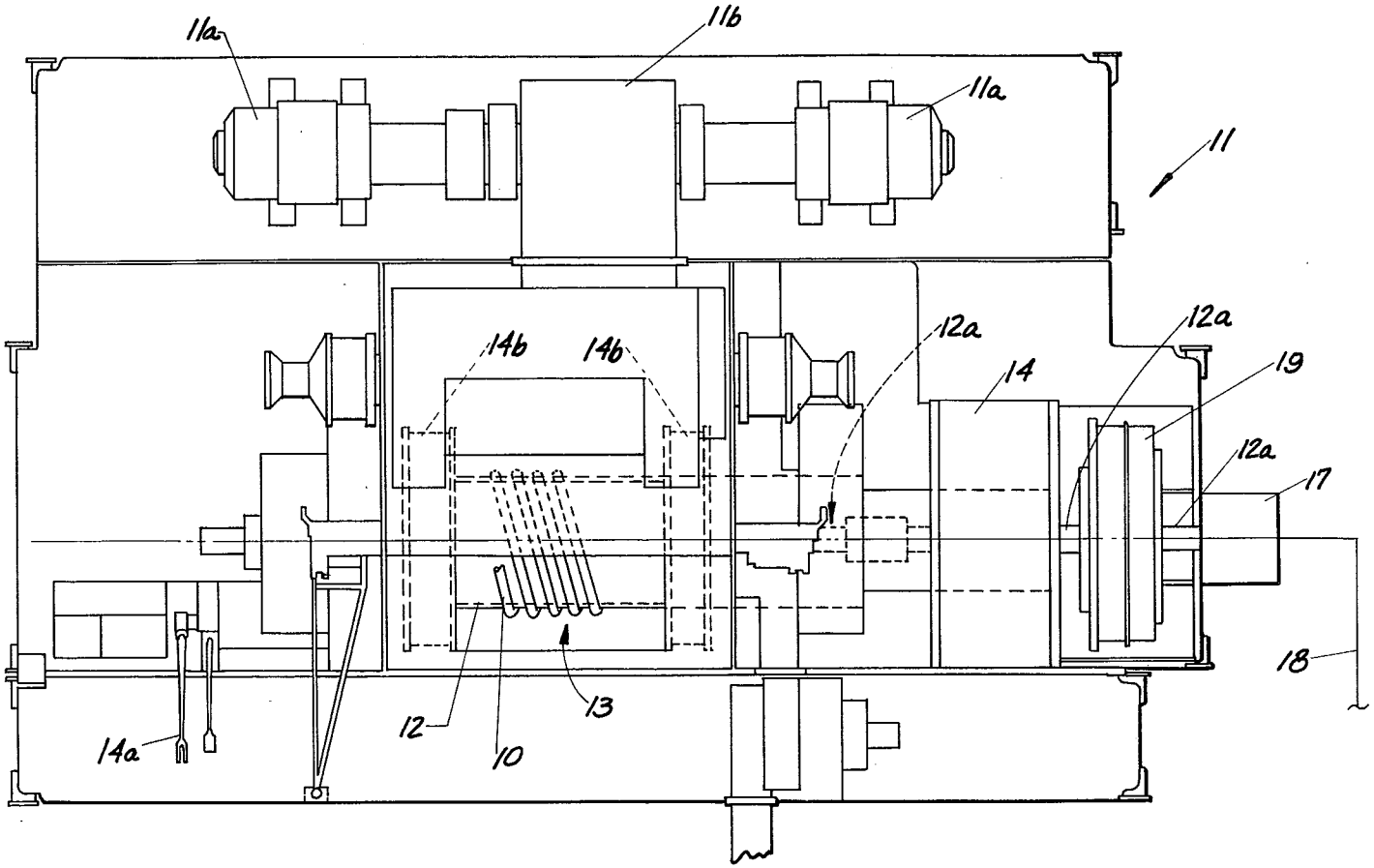
FIG. 4 is an enlarged fragmentary top plan view of the drawworks of the present invention.

Drawworks 11, which may be of Type 1625-DE manufactured by National Supply Company, Division of Armco, Inc. (see FIG. 4), includes one or more electric motors 11*a* and a suitable drive transmission 11*b* connected to a generally cylindrical rotatable drum 12 for wrapping the fast line 10 thereon as at 13. Drawworks 11 also includes an auxiliary brake 14, such as an Elmagco eddy current brake manufactured by Baylor Company connected to the drive shaft 12*a*.

The above apparatus described in connection with the drilling rig is entirely conventional and well understood in the art. In raising the hook block and the load attached thereto, motors 11*a* associated with drawworks 11 are activated to wind the fast line onto winding drum 12. Conversely, when the load attached to hook block 4 is to be lowered, electric motors 11*a* are disengaged, and the winding drum 12 permitted to rotate to pay out the fast line under the retarding effect of eddy current brake 14. In the event that a faster downward travel speed is required, brake 14 may be de-energized; furthermore, if the downward travel of hook block 4 is to be slowed, the braking action of brake 14 may be increasingly energized. As is well understood in the art, a primary friction brake shown generally at 14*b*, which may be of the band brake type, is operated by primary brake operating lever 14*a*, and may be used for normal braking stops and feeding of fast line from the hoisting drum.

As noted, the present invention is directed to preventing runaway load conditions where the downward speed of travel of the hook block and associated load is excessive under the particular load being handled and exceeds the normal braking capability of the primary brake 14*b* associated with drawworks 11.

In the preferred embodiment illustrated in FIG. 1, load sensing means comprising a conventional force sensing transducer 15 is attached to dead line 9, and produces an electrical signal on output line 16 representative of the tension in dead line 9 and consequently the load carried by hook block 4. Alternately, a conventional load cell or other load measuring device may be associated with derrick 1 to provide an electrical output signal representative of the load carried by hook block 4.

Means are also provided for producing an electrical signal representative of the vertical position of the hook block. In the preferred embodiment illustrated, the position sensing means comprises a conventional position encoder 17 non-rotatably secured to one end of the drive shaft 12*a* associated with brake 14 and winding drum 12. It will be understood that an electrical output signal will be produced on line 18 from position encoder 17 as winding drum 12 rotates to pay out fast line 10 as hook block 4 descends. Position encoder 17 may be any type of conventional position transducer such as a digital position encoder, tachometer or the like. Furthermore, it will be understood that other means may be utilized to sense the position of the hook block.

The control system of the present invention also includes emergency brake means 19 connected between eddy current brake 14 and position encoder 17, and attached to the winding drum shaft 12*a*. Emergency brake 19 may comprise a pneumatically operated Airflex brake manufactured by Airflex Division of Eaton Corporation, hydraulically actuated brake or spring actuated fail safe types. When activated by suitable pneumatic signals which will be described in more detail hereinafter, emergency brake 19 operates to stop rotation of winding drum 12 in order to stop downward travel of hook block 4.

Figure 2:
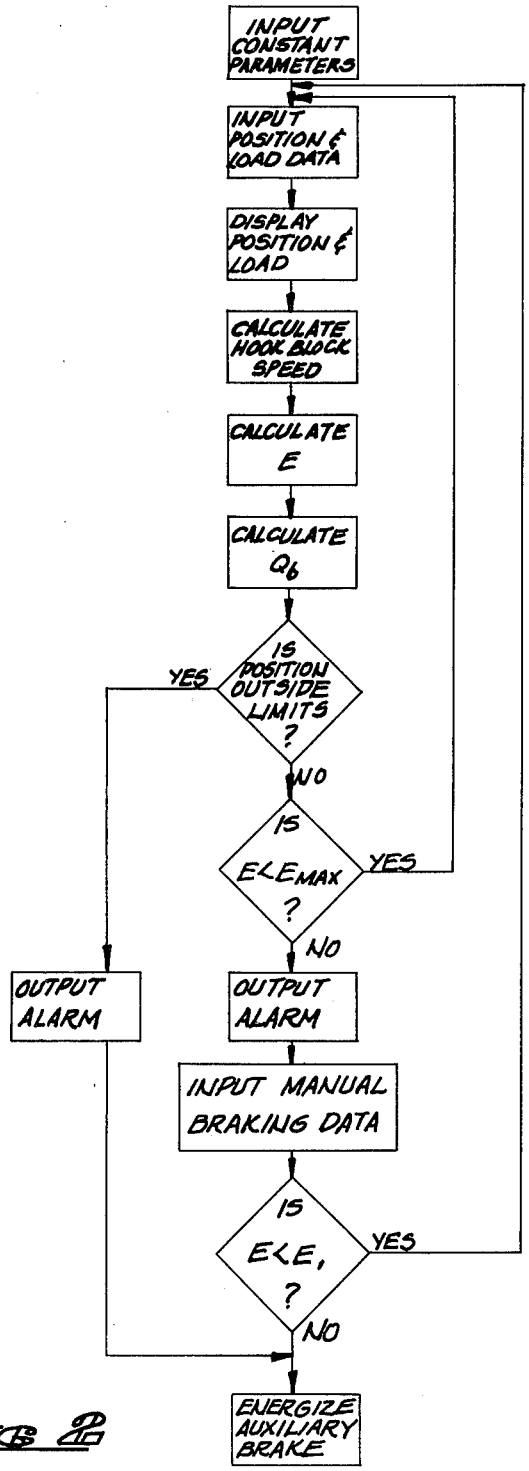
FIG. 2 is a flow diagram for the signal processing carried out in the processing means of the present invention.

A conventional signal processor 20, such as a general purpose digital computer, includes a control program represented by the flow diagram of FIG. 2 to produce output control signals causing activation of emergency brake 19 when the hook block position and/or speed reach predetermined levels. In particular, processor 20 calculates from the load and speed signals appearing on output line 16 and 18, respectively, an energy value that must be dissipated during a braking stop, and activates emergency brake 19 when the calculated energy value exceeds a predetermined value representative of the maximum energy absorbing capability of the primary manual band brake 14*b*. Processor 20 may be implemented as a MOSTEK MD X-CPU2 central processing unit (CPU), for example.

The load signal occurring on line 16 may be appropriately conditioned for use by processor 20 by a suitable conventional electronic interface 16*a* as is well known in the art. Likewise, the position signal occurring on line 18 may be suitably conditioned for use by processor 20 by a conventional electronic interface 18*a* as is well known in the art. For example, interfaces 16*a* and 18*a* may be implemented as buffer or level shifting amplifiers, digital logic drivers, etc., all of which are conventional devices and well known to those of ordinary skill in the art. Specifically, interface 16*a* may comprise a MOSTEK model MD X-A/DS A/DS IO module, while interface 18*a* may comprise a MOSKET model MD X-PIO digital I/O.

In a preferred processing arrangement illustrated in FIG. 2, the constant input parameters are first entered manually, or are included as part of the operating program. The input parameters 20*a* may be entered by means of a conventional keyboard 20*b* (see FIG. 1) using a conventional digital I/O interface 20*c* such as a MOSTEK MD X-PIO. These parameters include the desired stopping time, t of hook block 4; the polar mass moment of inertia, j of the entire shaft assembly contained in drawworks 11 which may also include associated sheaves and wire rope (depending on the degree of accuracy required); the pitch radius, r of fast line 10 on winding drum 12; and the acceleration of gravity constant, $g=32.2$ ft/sec$^2$. In addition, a value $E_{max}$ is entered corresponding to the normal safe energy dissipation rating of primary manual brake 14*b*, as well as a value $E_1$ corresponding to the maximum energy dissipation capacity for emergency stopping by primary brake 14*b*.

The hook block position information appearing on output line 18 and the total load data appearing in output line 16 are then stored in a random access memory (RAM) 20*d* associated with processor 20. For purposes of an exemplary showing, RAM 20*d* may comprise a conventional MOSTEK MD X-BRAM RAM. Actual hook block position may be displayed on a suitable visual display $D_1$, and hook block load displayed on a suitable visual display $D_2$.

It will be understood that both visual displays $D_1$ and $D_2$ are entirely conventional components. In addition, the signals supplied to displays $D_1$ and $D_2$ from processor 20 may be suitably conditioned by conventional interface devices $D_1'$ and $D_2'$ such as the MOSTEK MD X-A/DX I/O. From the rate of change of the position data, the downward velocity or speed of hook block 4 may be calculated in processor 20 as is well known in the art.

In the next phase of the system processing, the energy E that must be dissipated during a braking stop is calculated, as determined by the relationship:

$$E=(PVr/gt+Vj/gtr+Pr)Vt/2r,$$

wherein P is the hook block load, V is the hook block velocity, r is the pitch radius of the fast line on the drum, g is the gravitational constant, j is the polar mass moment of inertia of the drawworks, and t is the stopping time.

The torque, $Q_b$, required by the manual brake 14*b* or the emergency brake 19 in stopping the specific load at the particular hook block speed may be calculated from the relationship:

$$Q_b=2r\,E/Vt.$$

Figure 3:
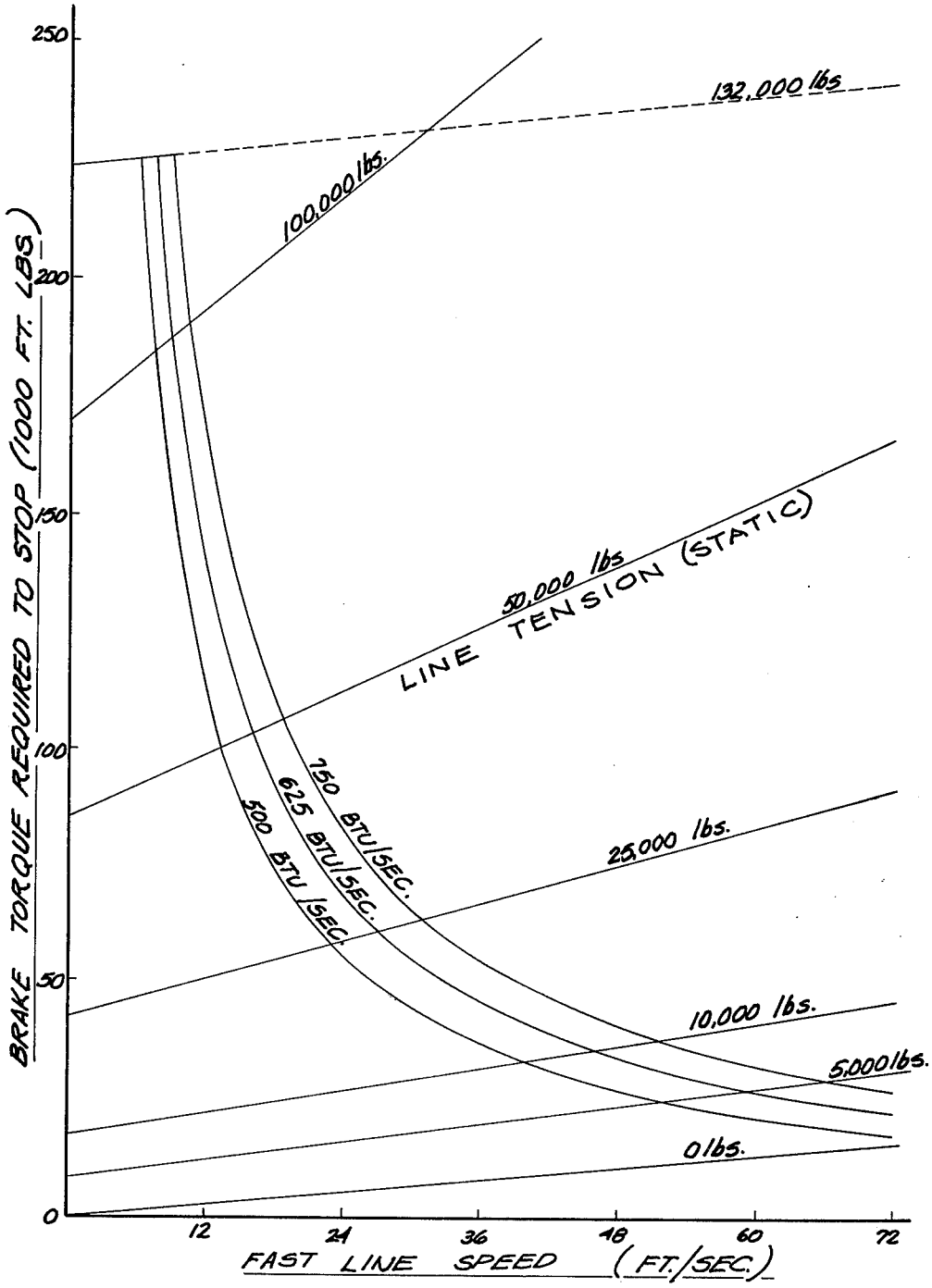
FIG. 3 is a graphical representation of the energy calculation characteristics of the hook load overspeed preventing system of the present invention.

The relationship between brake torque, load and velocity for a 3 second hook block stopping time is illustrated in FIG. 3 for a typical National Supply Company Type 1625-DE drawworks and several limits of maximum brake energy dissipation. By way of example, for a fast line velocity of slightly greater than 12 ft/sec and a line tension of 50,000 pounds, the required brake torque required to stop the load in 3 seconds is 100,000 ft-lbs, requiring the brake to dissipate 500 BTU/sec. It should be noted that the hook block and fast line speeds are directly related by the number of lines used in the block.

In order to prevent contact of the hook block with crown block 2 or the floor of derrick 1, the actual hook block position appearing on output line 18 may be compared with predetermined upper and lower limits. If the hook block position is safely within the established limits as determined by the negative branch in the flow processing diagram of FIG. 2, the processing continues. However, if the hook block exceeds either of the established limits, a signal is produced on output line 21 to cause emergency brake 19 to be energized as will be described in more detail hereinafter to stop travel of the hook block in either direction. At the same time, an output signal may be produced on line 22 to alarm 23 to provide an audible or visual indication that the position limits have been exceeded. A suitable conventional interface device 21*a* such as the MOSTEK MD X-D/A8 D/A I/O may be used to condition the signals supplied by processor 20 on line 21 (see FIG. 1) as is well known in the art. Likewise, a conventional interface device 22*a* such as a MOSTEK MD X-A/DS A/DS I/O may be used to condition the signals supplied by processor 20 on line 22 as is well known in the art.

Assuming that the hook block position is within safe limits, the calculated energy value E is compared with the first predetermined value $E_{max}$ representative of the normal safe energy dissipating rating of the drawworks primary band brake 14*b*. If the calculated energy is less than this predetermined value, the positive branch is taken and the aforementioned processing is repeated. However, if this first predetermined value $E_{max}$ is equal or exceeded, indicating that the normal safe operating limits of the primary brake 14*b* may be exceeded in attempting to bring to a stop the particular load being handled at the specific velocity in the time required, the negative branch is taken and a visual or audible alarm produced from alarm 23 to alert the drawworks operator that corrective action should be immediately taken. The operator may then manually cause the energization of the eddy current brake 14 to be increased to bring the downward moving hook block to a safe speed.

In the event that the braking action is not manually increased, either because of operator error or because the brake is inoperative, the processing tests to determine whether the calculated energy value E exceeds a second predetermined value $E_1$ representative of the maximum energy dissipation capacity for stopping of the load by primary brake 14*b*. If $E<E_1$, the processing branches back to the start of the program, and the above sequence of events is repeated. It should be pointed out that the output alarm will continue to be activated to apprise the operator of the possible overspeed condition. In the event that the calculated energy value has reached a level representative of the maximum energy dissipating capacity of the primary brake 14*b*, the emergency system is immediately and automatically energized. Consequently, the processor means produces an electrical signal, either to activate the alarm means or the emergency brake, to insure safe stopping of brake travel within the braking capability of the primary brake means.

For example, if the particular drawworks primary brake 14*b* being utilized has a normal safe energy dissipating rating of 625 BTU/sec, and a maximum energy dissipating capacity for emergency stopping of 750 BTU/sec, these values may be entered in processing means 20 as the values of Emax and $E_1$, respectively. Consequently, for the same wire rope tension of 50,000 lbs, the value of Emax (625 BTU/sec) will be exceeded when wire rope speed reaches about 16 ft/sec, whereupon the alarm 23 will be activated. In the event hook speed further increases to about 18.5 ft/sec, the value of $E_1$ (750 BUT/sec) will be exceeded, and the automatic braking sequence described hereinabove initiated.

A preferred control for pneumatically operated emergency brake 19 is illustrated in FIG. 1. In this arrangement, the brake is connected by means of air supply line 24 to double check valve 25. One input of the check valve is connected by means of air line 26 to an electrically operated pressure control valve 27 responsive to the output signal on line 21. As noted above, the electrical output from processor 20 is conditioned by interface device 21*a* to produce the appropriate signal level and duration on line 21. The other input of double check valve 25 is connected by means of air line 28 to electrically operated pressure control valve 29, which is responsive to an electrical signal on line 30 produced by conventional controller 31 (e.g. implemented by a model AD7502 4 channel analog multiplexer manufactured by Analog Devices of Norwood, Mass. as will be described in more detail hereinafter. Pressurized air is supplied to control valves 27 and 29 from an air source 32. If desired, a manual emergency control 25*b* may be used through check valve 25*a* to operate emergency brake 19.

In the event that hook block 4 has exceeded the predetermined vertical position limits as described hereinabove, an electrical signal will be produced on output line 21 to cause electrical pressure control valve 27 to immediately activate pneumatic emergency brake 19. In a like manner, if the calculated energy value E equals or exceeds the value $E_1$ representative of the maximum energy dissipating capacity of the primary brake 14*b*, an electrical signal will be produced on line 33 to controller 31 to immediately activate pressure control valve 29 and consequently energize emergency brake 19. Signals produced by processor 20 and applied on lines 33 and 34 to controller 31 may be conditioned by conventional interface devices 33*a* and 34*a*, respectively, such as the MOSTEK MD X-D/A8 D/A I/O as is well known in the art.

However, in some instances it may be desirable to provide controlled slowing of the winding drum 12 by torque regulation of emergency brake 19. In this instance, the value of the calculated torque $Q_b$ may be provided through controller 31 to proportionally control pressure control valve 29 and provide the required torque of the emergency brake 19. Since the calculated braking torque is proportional to the pressure, a controlled stopping time can be provided. It will be understood that such controlled stopping utilizing the $Q_b$ value on line 34 from processor 20 may be utilized in connection with any of the comparisons noted hereinabove; viz., when the hook block position has exceeded the established limits, when the calculated energy value E equals or exceeds the first predetermined value $E_{max}$ representative of the normal safe energy dissipating rating of the primary band brake 14*b*, or when the calculated energy value E equals or exceeds the second predetermined value $E_1$ representative of the maximum energy dissipating capacity of the primary band brake 14*b*.

It will be understood that various changes in the details, materials, steps and arrangements of parts, which have been herein described and illustrated in order to explain the nature of the invention may be made within the principle and scope of the invention as defined by the appended claims. For example, while for purposes of an exemplary showing, the present system has been described and illustrated in connection with an emergency brake 19, it will be understood that the control signals produced may be applied to the drawworks primary band brake 14*b*. Of course, it will be understood that this type of arrangement lacks the redundancy of an emergency brake which can provide reliable stopping of the downwardly moving hook block in the event of primary brake failure. Furthermore, it will be understood that different types of emergency brakes such as caliper disc brakes and the like may also be provided, as well as means for activating such brakes, all within the scope of the present invention.

The embodiments of the invention in which an exclusive property or privilege is claimed are as follows:

1. In an oil drilling rig of the type having a traveling hook block mounted for vertical movement and means for raising and lowering said block, the improvement in combination therewith comprising means for preventing runaway lowering of said block including:

means producing a signal representative of the load carried by said block;

means producing a signal representative of the vertical position of said block;

brake means for slowing downward travel of said block; and processor means including means for calculating from said position signal a signal representative of the downward speed of said block, and means utilizing said speed and load signals to produce an electrical signal for insuring safe stopping of block travel within the braking capability of said brake means, said processor means including means for continually calculating from said speed and load signals an energy value which must be dissipated during a braking stop for that speed and load and means responsive to said electrical signal for activating said brake means for slowing downward travel of said block when the calculated energy value reaches a predetermined value representative of the maximum energy absorbing capability of said brake means.

2. The apparatus according to claim 1 wherein said rig includes a supporting derrick, a hoisting rope for raising and lowering said block, one end of said rope being fixedly secured to form a dead line, the other end of said rope forming a fast line, and drawworks means for raising and lowering said block, said drawworks means including a rotatable drum for wrapping said fast line thereon, said brake means operating to limit the rotation of said drum when said block is being lowered.

3. The apparatus according to claim 2 wherein said load sensing means is associated with said dead line.

4. The apparatus according to claim 3 wherein said block position signal producing means is responsive to the rotation of said drum.

5. The apparatus according to claim 3 including means responsive to said position signal for activating said brake means when the block position reaches predetermined limits.

6. The apparatus according to claim 5 wherein said predetermined limits are set to prevent block contact with the ground and the top of the derrick, respectively.

7. The apparatus according to claim 6 including indicator means for providing a display of actual block position.

8. The apparatus according to claim 7 including alarm means for providing an indication when the block position exceeds said predetermined limits.

9. The apparatus according to claim 1 wherein said processor means includes means for providing a first electrical signal when said calculated energy value reaches a first predetermined value representative of the normal safe energy dissipating rating of said braking means and means for producing a second electrical signal when said calculated energy value reaches a second predetermined value representative of the maximum energy dissipating capacity of said brake means for emergency stopping.

10. The apparatus according to claim 9 including means responsive to said second electrical signal for activating said brake means.

11. The apparatus according to claim 10 including means responsive to one at least of said first and second electrical signals for providing an alarm indication.

12. The apparatus according to claim 2 wherein said processor means includes means for calculating said energy value E according to the relationship:

$$E=(PVr/gt+Vj/gtr+Pr)Vt/2r,$$

wherein P is the block load, V is the block velocity, r is the pitch radius of the fast line on the drum, g is the gravitational constant, j is the polar mass moment of inertia of said drawworks means, and t is the stopping time.

13. The apparatus according to claim 2 wherein said processor means includes means for calculating the required brake means torque, $Q_b$.

14. The apparatus according to claim 11 including means for actuating said brake means for slowing rotation of said drum to provide a controlled stopping time proportional to the value of required brake torque, $Q_b$.

15. The apparatus according to claim 14 wherein said torque is calculated according to the relationship:

$$Q_b = 2r\,E/Vt,$$

wherein E is said calculated energy value, r is the pitch radius of the fast line on the drum, V is the block velocity, and t is the stopping time.

16. The apparatus according to claim 2 including means for actuating said brake means to provide controlled slowing of said drum.

17. The apparatus according to claim 2 wherein said brake means includes primary brake means for providing normal retarding of said drum and emergency brake means for providing emergency retarding of said drum, said emergency brake means being responsive to said electrical signal.

18. The apparatus according to claim 17 wherein said emergency brake means is pneumatically operated.

19. The apparatus according to claim 17 wherein said processor means includes means for providing a first electrical signal when said calculated energy value reaches a first predetermined value representative of the normal safe energy dissipating rating of said primary brake means and means for producing a second electrical signal when said calculated energy value reaches a second predetermined value representative of the maximum energy dissipating capacity of said primary brake means for emergency stopping, said emergency brake means being responsive to said second electrical signal.

20. The apparatus according to claim 19 including means responsive to one at least of said first and second electrical signals for producing an alarm indication.

21. The apparatus according to claim 1 including means for providing a visual display of hook block load.

* * * * *